US010954970B2

(12) United States Patent
Kondo

(10) Patent No.: US 10,954,970 B2
(45) Date of Patent: Mar. 23, 2021

(54) HYDRAULIC DRIVE DEVICE FOR INDUSTRIAL VEHICLE

(71) Applicant: KABUSHIKI KAISHA TOYOTA JIDOSHOKKI, Kariya (JP)

(72) Inventor: Eisuke Kondo, Aichi-ken (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 0 days.

(21) Appl. No.: 16/722,682

(22) Filed: Dec. 20, 2019

(65) Prior Publication Data

US 2020/0208379 A1 Jul. 2, 2020

(30) Foreign Application Priority Data

Dec. 26, 2018 (JP) ..... JP2018-242906

(51) Int. Cl.
*F15B 11/16* (2006.01)
*E02F 9/22* (2006.01)

(52) U.S. Cl.
CPC ..... *F15B 11/165* (2013.01); *E02F 9/2296* (2013.01); *F15B 11/166* (2013.01); *E02F 9/2235* (2013.01); *E02F 9/2267* (2013.01); *E02F 9/2285* (2013.01); *F15B 2211/20546* (2013.01); *F15B 2211/6652* (2013.01)

(58) Field of Classification Search
CPC ..... F15B 11/162; F15B 11/165; F15B 11/166; E02F 9/2285
USPC ..... 60/422, 452
See application file for complete search history.

(56) References Cited

U.S. PATENT DOCUMENTS 4,745,747 A * 5/1988 Krausse ..... B62D 5/09 60/452
5,398,507 A * 3/1995 Akiyama ..... E02F 9/2232 60/452
8,281,583 B2 * 10/2012 Kauss ..... E02F 9/2285 60/422
10,247,207 B2 * 4/2019 Goto ..... F15B 13/024
2009/0094972 A1 4/2009 Kauss
2017/0130742 A1 5/2017 Goto et al.

FOREIGN PATENT DOCUMENTS

JP 2018-025137 A 2/2018

OTHER PUBLICATIONS

Communication dated Mar. 23, 2020 by the European Patent Office in application No. 19216969.6.

* cited by examiner

*Primary Examiner* — Michael Leslie
(74) *Attorney, Agent, or Firm* — Sughrue Mion, PLLC

(57) ABSTRACT

A hydraulic drive device for an industrial vehicle includes a tank, a hydraulic pump, a capacity control valve, a plurality of hydraulic cylinders, a plurality of direction switching valves, a first hydraulic oil passage, a second hydraulic oil passages, a pilot line, a relief valve, a relief pressure setting portion, a plurality of operation detecting portions, and a control unit. The control valve controls the hydraulic pumps so that a differential pressure between a discharge pressure of the hydraulic pump and a pilot pressure of the pilot line is to be a predetermined pressure. The control unit controls the relief pressure setting portion.

3 Claims, 6 Drawing Sheets

HYDRAULIC DRIVE DEVICE FOR INDUSTRIAL VEHICLE

CROSS-REFERENCE TO RELATED APPLICATION

This application claims priority to Japanese Patent Application No. 2018-242906 filed on Dec. 26, 2018, the entire disclosure of which is incorporated herein by reference.

BACKGROUND ART

The present disclosure relates to a hydraulic drive device for an industrial vehicle.

Japanese Patent Application Publication No. 2018-25137 discloses a conventional technique as a hydraulic drive device for an industrial vehicle. The hydraulic drive device described in the Publication No. 2018-25137 includes a variable capacity type hydraulic pump, a regulator changing a tilt angle of the hydraulic pump, and a pilot circuit supplying pilot pressure to the regulator. The pilot circuit has a pilot hydraulic source and a control valve disposed between the pilot hydraulic source and the regulator. The control valve increases pilot pressure supplied to the regulator by controlling pilot pressure from the pilot hydraulic source as discharge pressure of the hydraulic pump increases.

By the way, upper limit pressure of hydraulic oil discharged from the hydraulic pump is determined, for example, by adjusting an adjust screw disposed in the control valve. Thus, the upper limit pressure of hydraulic oil discharged from the hydraulic pump is constant regardless of an operated hydraulic cylinder.

The present disclosure is directed to providing a hydraulic drive device for an industrial vehicle that may change upper limit pressure of hydraulic oil discharged from a hydraulic pump corresponding to an operated hydraulic cylinder.

SUMMARY

In accordance with an aspect of the present disclosure, there is provided a hydraulic drive device for an industrial vehicle that includes a tank for storing hydraulic oil, a hydraulic pump that is of a variable capacity type, driven by an engine and discharges hydraulic oil stored in the tank, a capacity control valve controlling the hydraulic pump, a plurality of hydraulic cylinders driven by hydraulic oil discharged from the hydraulic pump, a plurality of direction switching valves disposed between the hydraulic pump and the plurality of the hydraulic cylinders and switching a flow direction of the hydraulic oil in accordance with operation of a plurality of operation tools, a first hydraulic oil passage connecting the hydraulic pump and the plurality of the direction switching valves, and through which the hydraulic oil discharged from the hydraulic pump flows, a second hydraulic oil passages connecting the plurality of the direction switching valves and the plurality of the hydraulic cylinders, and through which the hydraulic oil supplied to the hydraulic cylinders flows, a pilot line connecting the plurality of the direction switching valves and the capacity control valve, and supplying a pilot pressure generated when hydraulic oil is supplied to the hydraulic cylinder to the capacity control valve, a relief valve disposed between the pilot line and the tank, and that opens when the pilot pressure generated in the pilot line is equal to or greater than a relief pressure, a relief pressure setting portion that sets the relief pressure of the relief valve, a plurality of operation detecting portions detecting operation states of the plurality of the operation tools, and a control unit controlling the relief pressure setting portion on the basis of operation states of the plurality of the operation tools detected by the plurality of the operation detecting portions. The capacity control valve controls the hydraulic pumps so that a differential pressure between a discharge pressure of the hydraulic pump and the pilot pressure of the pilot line is to be a predetermined pressure, and controls the hydraulic pump so that the discharge pressure of the hydraulic pump is to be a predetermined upper limit pressure or less. The control unit controls the relief pressure setting portion so that the relief pressure of the relief valve is different in accordance with the case where one of the plurality of the operation tools has been operated or the other operation tools has been operated.

Other aspects and advantages of the disclosure will become apparent from the following description, taken in conjunction with the accompanying drawings, illustrating by way of example the principles of the disclosure.

BRIEF DESCRIPTION OF THE DRAWINGS

The disclosure, together with objects and advantages thereof, may best be understood by reference to the following description of the embodiments together with the accompanying drawings in which.

DETAILED DESCRIPTION OF THE EMBODIMENTS

Figure 1:
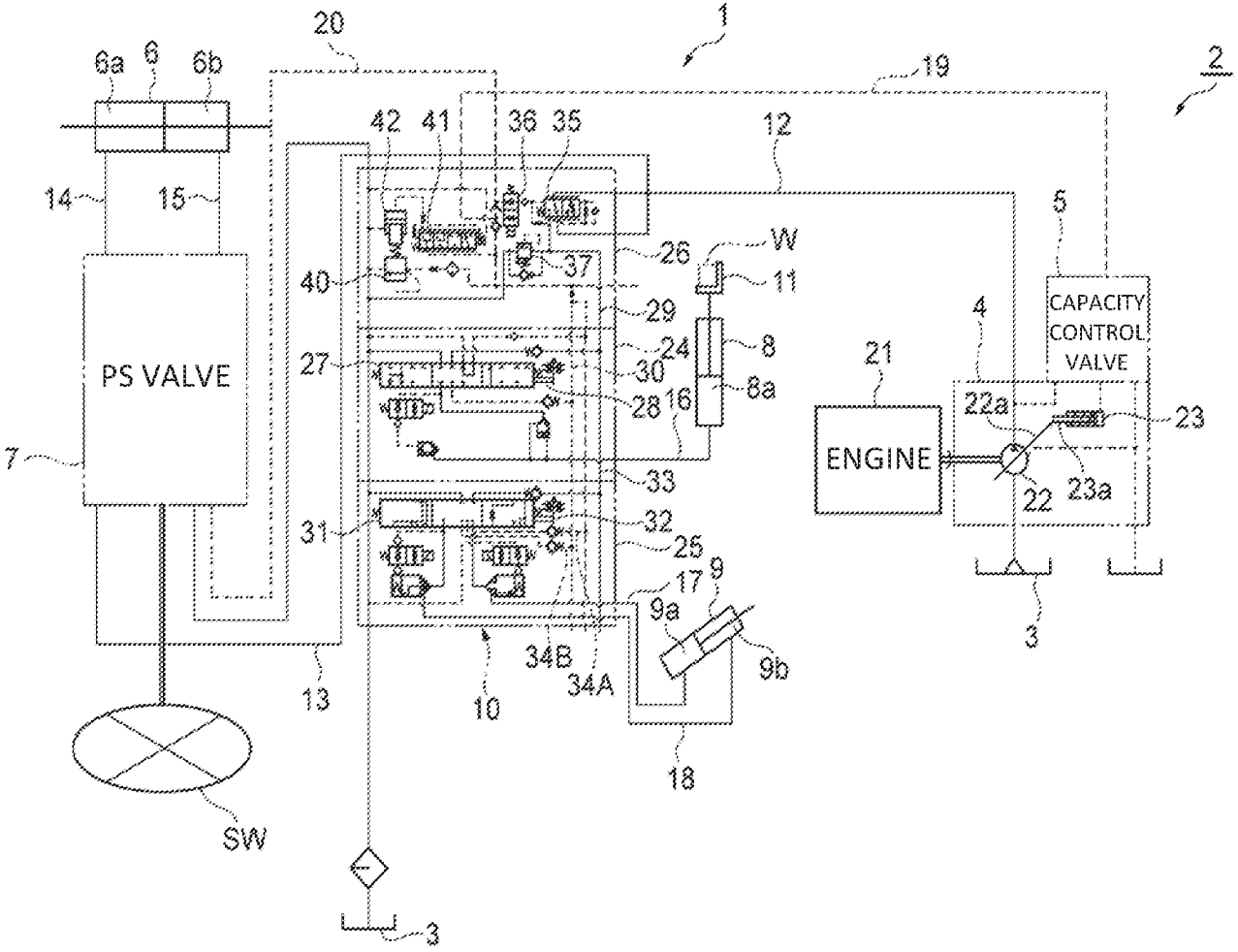
FIG. 1 is a hydraulic circuit diagram showing a hydraulic drive device for an industrial vehicle according to an embodiment of the present disclosure.

The following will describe embodiments according to the present disclosure in detail with reference to the accompanying drawings. In the drawings, the same or equivalent elements are denoted by the same reference numerals, and redundant description is omitted.

FIG. 1 is a hydraulic circuit diagram showing a hydraulic drive device for an industrial vehicle according to an embodiment of the present disclosure. As shown in FIG. 1, a hydraulic drive device 1 of the present embodiment is mounted to an engine type forklift 2 corresponding to an industrial vehicle.

The hydraulic drive device 1 includes a tank 3 for storing hydraulic oil, a hydraulic pump 4 that is of a variable capacity type, discharging hydraulic oil stored in the tank 3, a capacity control valve 5 controlling the hydraulic pump 4, a power steering cylinder 6 driven by hydraulic oil discharged from the hydraulic pump 4, a power steering valve 7 disposed between the hydraulic pump 4 and the power steering cylinder 6, a lift cylinder 8 and a tilt cylinder 9 driven by hydraulic oil discharged from the hydraulic pump 4, and an oil control valve 10 disposed between the hydraulic pump 4, and the lift cylinder 8 and the tilt cylinder 9.

The lift cylinder 8 and the tilt cylinder 9 configure a plurality of hydraulic cylinders for loading and unloading operations. The lift cylinder 8 is a hydraulic cylinder raising and lowering a pair of forks 11 attached to a mast (not shown). Cargos W are stacked on the forks 11. In other word, the lift cylinder 8 corresponds to a hydraulic cylinder raising and lowering the cargos W. The tilt cylinder 9 corresponds to a hydraulic cylinder tilting the mast.

The hydraulic drive device 1 also includes a hydraulic oil passage 12 connecting the hydraulic pump 4 and the oil control valve 10, a hydraulic oil passage 13 connecting the oil control valve 10 and the power steering valve 7, hydraulic oil passages 14, 15 connecting the power steering valve 7 and the power steering cylinder 6, a hydraulic oil passage 16 connecting the oil control valve 10 and the lift cylinder 8, hydraulic oil passages 17, 18 connecting the oil control valve 10 and the tilt cylinder 9, a pilot line 19 connecting the oil control valve 10 and the capacity control valve 5, and a pilot line 20 connecting the power steering valve 7 and the oil control valve 10.

The hydraulic pump 4 is driven by an engine 21, and has a pump main body 22 and a control cylinder 23. The pump main body 22 pumps up hydraulic oil from the tank 3 and discharges the hydraulic oil. The control cylinder 23 has a piston 23*a* fixed to a swash plate 22*a* of the pump main body 22.

The capacity control valve 5 controls the control cylinder 23 to control an angle of the swash plate 22*a* of the pump main body 22 so that a differential pressure between a discharge pressure of hydraulic oil discharged from the hydraulic pump 4 (hereinafter, called a discharge pressure of the hydraulic pump 4) and a pilot pressure of the pilot line 19 is set to a predetermined pressure (called a pump control pressure). The capacity control valve 5 controls the swash plate 22*a* so as to increase an angle of the swash plate 22*a* when the differential pressure between a discharge pressure of the hydraulic pump 4 and a pilot pressure of the pilot line 19 is lower than the predetermined pressure. The capacity control valve 5 also controls the control cylinder 23 to control an angle of the swash plate 22*a* so that the discharge pressure of the hydraulic pump 4 is to be a predetermined upper limit pressure (called a pump cut-off pressure) or less.

The power steering cylinder 6 corresponds to a hydraulic cylinder, which is of a double rod type. The power steering valve 7 corresponds to a direction switching valve switching a flow direction of hydraulic oil in accordance with an operation direction of a steering wheel SW corresponding to an operation tool. The hydraulic oil passage 14 connects the power steering valve 7 and a first hydraulic chamber 6*a* of the power steering cylinder 6. The hydraulic oil passage 15 connects the power steering valve 7 and a second hydraulic chamber 6*b* of the power steering cylinder 6. The hydraulic oil passages 14, 15 are flow passages through which hydraulic oil supplied to the power steering cylinder 6 from the hydraulic pump 4 flows.

The oil control valve 10 includes a lift section 24, a tilt section 25, and an inlet section 26.

The lift section 24 has a lift valve 27 disposed between the hydraulic pump 4 and the lift cylinder 8. A lift lever 28, which corresponds to an operation tool for operating the lift cylinder 8, is connected to the lift valve 27. The lift valve 27 corresponds to a direction switching valve switching a flow direction of hydraulic oil in accordance with an operation direction of the lift lever 28.

A hydraulic oil passage 29, the above hydraulic oil passage 16, and a pilot line 30 are connected to the lift valve 27. The hydraulic oil passage 29 is connected to the above hydraulic oil passage 12 via a priority valve 35 (described later). The hydraulic oil passage 29 is a flow passage (a first hydraulic oil passage) through which hydraulic oil discharged from the hydraulic pump 4 flows. The hydraulic oil passage 16 connects the lift valve 27 and a bottom chamber 8*a* of the lift cylinder 8. The hydraulic oil passage 16 is a flow passage (a second hydraulic oil passage) through which hydraulic oil supplied to the lift cylinder 8 from the hydraulic pump 4 flows.

The pilot line 30 is connected to the above pilot line 19 via a shuttle valve 38 (described later). The pilot line 30 supplies a pilot pressure generated when hydraulic oil is supplied to the lift cylinder 8 as a load feedback pressure to the capacity control valve 5.

The tilt section 25 has a tilt valve 31 disposed between the hydraulic pump 4 and the tilt cylinder 9. A tilt lever 32, which corresponds to an operation tool for operating the tilt cylinder 9, is connected to the tilt valve 31. The tilt valve 31 corresponds to a direction switching valve switching a flow direction of hydraulic oil in accordance with an operation direction of the tilt lever 32.

A hydraulic oil passage 33, the above hydraulic oil passages 17, 18, and pilot lines 34A, 34B are connected to the tilt valve 31. The hydraulic oil passage 33 is connected to the hydraulic oil passage 29. The hydraulic oil passage 33 is a flow passage (the first hydraulic oil passage) through which hydraulic oil discharged from the hydraulic pump 4 flows. The hydraulic oil passage 17 connects the tilt valve 31 and a bottom chamber 9*a* of the tilt cylinder 9. The hydraulic oil passage 18 connects the tilt valve 31 and a rod chamber 9*b* of the tilt cylinder 9. The hydraulic oil passages 17, 18 are flow passages (the second hydraulic oil passages) through which hydraulic oil supplied to the tilt cylinder 9 from the hydraulic pump 4 flows.

The pilot lines 34A, 34B are connected to the pilot line 30. The pilot line 34A supplies a pilot pressure generated when hydraulic oil is supplied to the bottom chamber 9*a* of the tilt cylinder 9 as a load feedback pressure to the capacity control valve 5. The pilot line 34B supplies a pilot pressure generated when hydraulic oil is supplied to the rod chamber 9*b* of the tilt cylinder 9 as a load feedback pressure to the capacity control valve 5. The pilot lines 19, 30, 34A, 34B cooperate to connect the lift valve 27 and the tilt valve 31, and the capacity control valve 5.

Figure 2:
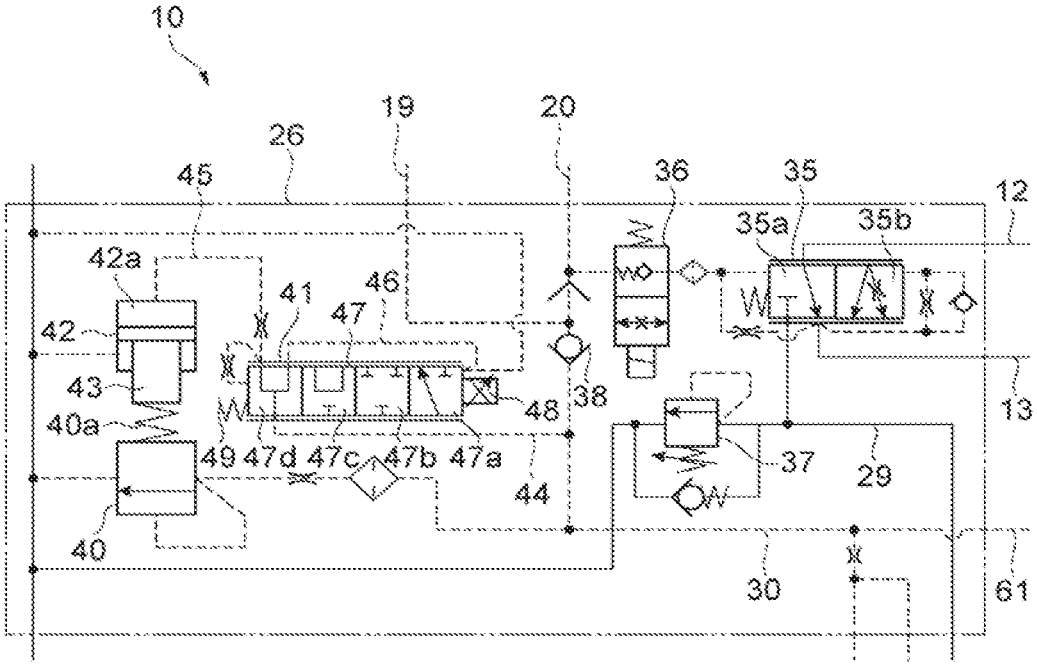
FIG. 2 is an enlarged hydraulic circuit diagram of an inlet section illustrated in FIG. 1.

Referring to FIG. 2 as well as FIG. 1, the inlet section 26 has the priority valve 35 disposed between the hydraulic pump 4, the power steering valve 7, and the lift valve 27 and the tilt valve 31, a pressure control valve 36 controlling the priority valve 35, and a relief valve 37 disposed between the hydraulic oil passage 29 and the tank 3.

The above hydraulic oil passages 12, 13, 29 are connected to the priority valve 35. The hydraulic oil passages 12, 13 are flow passages connecting the hydraulic pump 4 and the power steering valve 7, and through which hydraulic oil discharged from the hydraulic pump 4 flows. The hydraulic oil passages 12, 29, 33 are flow passages (first hydraulic oil passages) connecting the hydraulic pump 4, the lift valve 27, and the tilt valve 31, and through which hydraulic oil discharged from the hydraulic pump 4 flows.

The priority valve 35 is a switching valve switching between a position 35*a* for mainly supplying hydraulic oil from the hydraulic pump 4 to the power steering valve 7 and a position 35*b* for supplying hydraulic oil from the hydraulic pump 4 to the power steering valve 7 as well as to the lift valve 27 and the tilt valve 31. The pressure control valve 36 controls the priority valve 35 so as to preferentially supply hydraulic oil from the hydraulic pump 4 to the power steering valve 7. The relief valve 37 is a pressure adjustment valve that opens when a pressure of the hydraulic oil passage 29 is equal to or greater than a relief pressure.

The inlet section 26 has the shuttle valve 38 disposed between the capacity control valve 5, the power steering valve 7, the lift valve 27, and the tilt valve 31. The above pilot lines 19, 20, 30 are connected to the shuttle valve 38. The shuttle valve 38 outputs a higher pilot pressure of the pilot line 20 and the pilot line 30 to the pilot line 19.

Furthermore, the inlet section 26 has a relief valve 40 disposed between the pilot line 30 and the tank 3, an electromagnetic proportional valve 41 connected to the pilot line 30, and a pressure cylinder 42 disposed between the electromagnetic proportional valve 41 and the relief valve 40.

The relief valve 40 is a pressure adjustment valve that opens when pilot pressure generated in the pilot line 30 is equal to or greater than a relief pressure. The relief valve 40 has a spring 40*a* for setting the relief pressure.

The electromagnetic proportional valve 41 and the pressure cylinder 42 cooperate with the spring 40*a* to configure a relief pressure setting portion that sets a relief pressure of the relief valve 40. The pressure cylinder 42 has a piston 43 pressing the relief valve 40 via the spring 40*a*.

A pilot line 44 branching off from the pilot line 30, a pilot line 45 connected to a bottom chamber 42*a* of the pressure cylinder 42, and a pilot line 46 connected to the tank 3 are connected to the electromagnetic proportional valve 41.

The electromagnetic proportional valve 41 has a spool type valve body 47, a solenoid operation unit 48 disposed in a first end side of the valve body 47, and to which an electric signal (electric current) for moving the valve body 47 is input, and a spring 49 disposed in a second end side of the valve body 47.

The valve body 47 is movable between an open position 47*a*, a neutral position 47*b*, and unloading positions 47*c*, 47*d* from a side of the solenoid operation unit 48 toward a side of the spring 49 in response to an electric signal input into the solenoid operation unit 48.

While the valve body 47 is at the open position 47*a*, the pilot lines 44, 45 communicate with each other, and the pilot lines 45, 46 are shut off from each other. While the valve body 47 is at the neutral position 47*b*, the pilot lines 44 to 46 are shut off from each other. While the valve body 47 is at the unloading position 47*c*, the pilot lines 45, 46 communicate with each other, and the pilot lines 44, 45 are shut off from each other. While the valve body 47 is at the unloading position 47*d*, the pilot lines 44 to 46 communicate with each other.

While the valve body 47 is at a full open position or a nearly full open position in the open position 47*a* (defined as a first position), a pilot pressure generated in the pilot line 30 is supplied to the bottom chamber 42*a* of the pressure cylinder 42, and the relief valve 40 is pressed by the piston 43 of the pressure cylinder 42 with a force corresponding to the pilot pressure. Thus, a relief pressure of the relief valve 40 is set to a pressure A corresponding to the pilot pressure generated in the pilot line 30. The pressure A is equal to or greater than the pump cut-off pressure (described above).

While the valve body 47 is at the neutral position 47*b* or a closer position to the neutral position 47*b* than the first position in the open position 47*a* (defined as a second position), compared to the case wherein the valve body 47 is at the first position, a pressure of the bottom chamber 42*a* of the pressure cylinder 42 becomes lower. This lowers pressure force of the piston 43. Accordingly, a relief pressure of the relief valve 40 is set to a pressure B that is lower than the pressure A. The pressure B is lower than the pump cut-off pressure (described above).

While the valve body 47 is at the unloading position 47*c* or the unloading position 47*d* (defined as a third position), a pressure of the bottom chamber 42*a* of the pressure cylinder 42 becomes a tank pressure. This lowers a pressure of the piston 43 compared to the case wherein the valve body 47 is at the second position. Accordingly, a relief pressure of the relief valve 40 is set to a pressure C that is lower than the pressure B.

Figure 3:
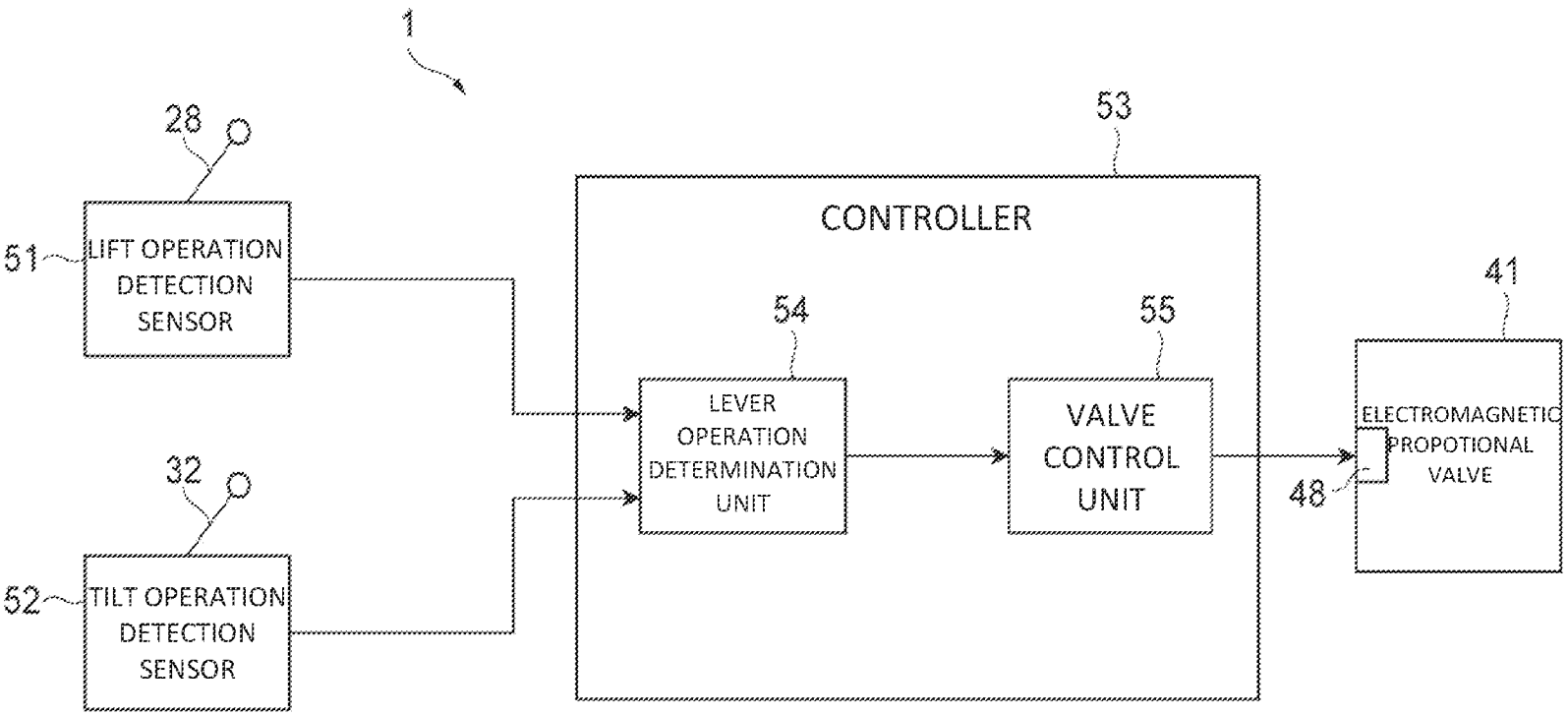
FIG. 3 is a block diagram showing a control system of the hydraulic drive device illustrated in FIG. 1.

FIG. 3 is a block diagram showing a control system of the hydraulic drive device 1 illustrated in FIG. 1. As illustrated in FIG. 3, the hydraulic drive device 1 includes a lift operation detection sensor 51, a tilt operation detection sensor 52, and a controller 53 (control unit).

The lift operation detection sensor 51 detects an operation state of the lift lever 28. The tilt operation detection sensor 52 detects an operation state of the tilt lever 32. The lift operation detection sensor 51 and the tilt operation detection sensor 52 configure a plurality of operation detecting portions detecting operation states of a plurality of operation tools. The operation states of the lift lever 28 and the tilt lever 32 are operation directions, operation amounts, operation velocities, or the like of the lift lever 28 and the tilt lever 32. A potentiometer or the like is used as the lift operation detection sensor 51 and the tilt operation detection sensor 52.

The controller 53 is configured of a CPU, a RAM, a ROM, and an input/output interface or the like. The controller 53 has a lever operation determination unit 54 and a valve control unit 55.

The lever operation determination unit 54 determines whether or not the lift lever 28 and the tilt lever 32 are operated on the basis of operation states of the lift lever 28 detected by the lift operation detection sensor 51 and the tilt lever 32 detected by the tilt operation detection sensor 52.

The valve control unit 55 of the controller 53 controls the solenoid operation unit 48 of the electromagnetic proportional valve 41 in accordance with a determined result by the lever operation determination unit 54. Then, the valve control unit 55 of the controller 53 controls the solenoid operation unit 48 of the electromagnetic proportional valve 41 so that a relief pressure of the relief valve 40 when the lift lever 28 is operated is different from a relief pressure of the relief valve 40 when the tilt lever 32 is operated.

Figure 4:
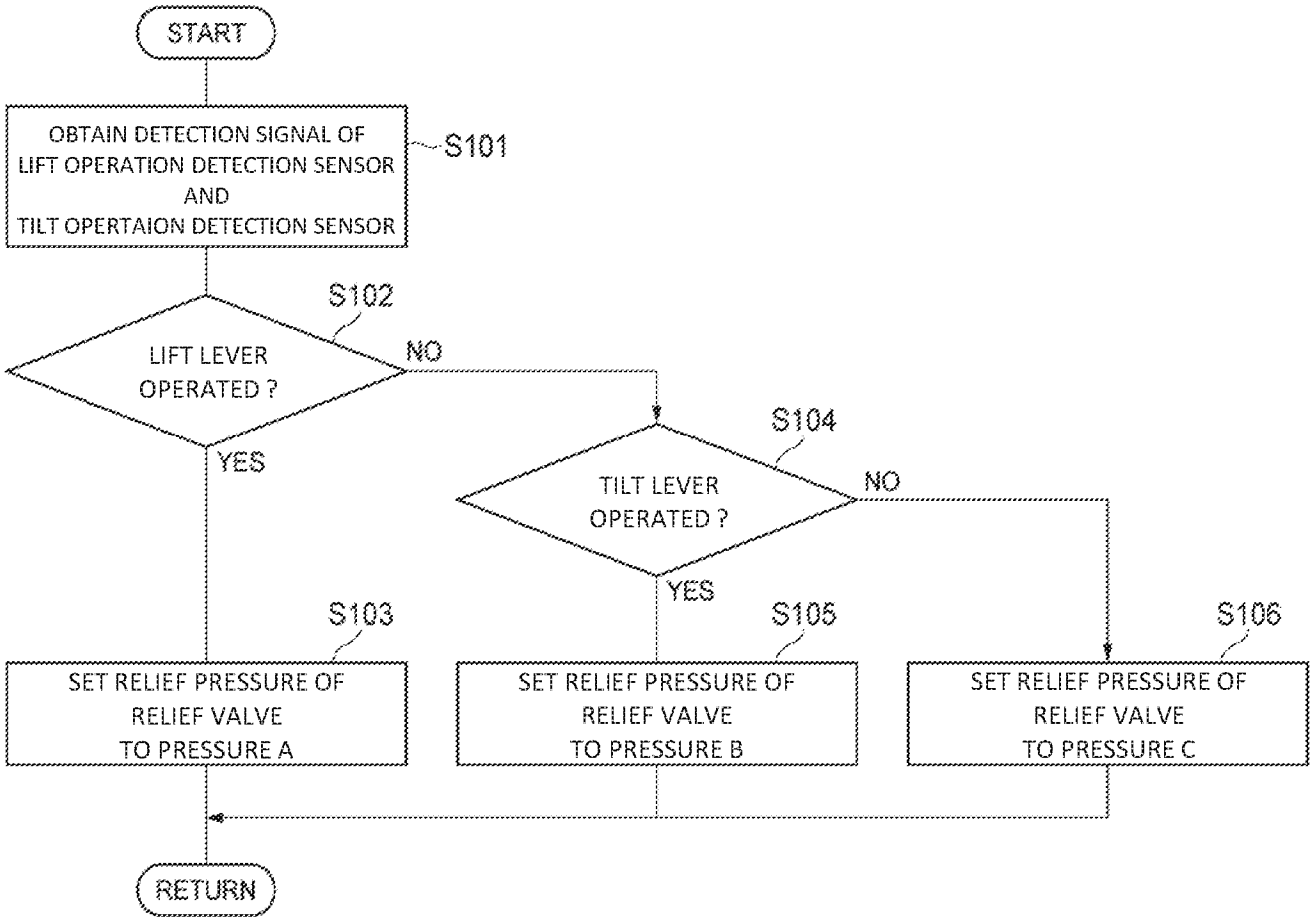
FIG. 4 is a flow chart showing steps of a control process performed by a controller illustrated in FIG. 3.

FIG. 4 is a flow chart showing steps of a control process performed by the controller 53. As illustrated in FIG. 4, the controller 53 firstly obtains detection signals of the lift operation detection sensor 51 and the tilt operation detection sensor 52 (step S101).

Subsequently, the controller 53 determines whether or not the lift lever 28 is operated on the basis of a detection signal of the lift operation detection sensor 51 (step S102). When the controller 53 determines that the lift lever 28 has been operated (YES at S102), the controller 53 outputs an electric signal for moving the valve body 47 of the electromagnetic proportional valve 41 to the first position to the solenoid operation unit 48 of the electromagnetic proportional valve 41 so that a relief pressure of the relief valve 40 is set to the pressure A equal to or greater than the pump cut-off pressure (step S103).

When the controller 53 determines that the lift lever 28 has not been operated (NO at S102), the controller 53 determines whether or not the tilt lever 32 is operated on the basis of a detection signal of the tilt operation detection sensor 52 (step S104). When the controller 53 determines that the tilt lever 32 has been operated (YES at S104), the controller 53 outputs an electric signal for moving the valve body 47 of the electromagnetic proportional valve 41 to the second position to the solenoid operation unit 48 of the electromagnetic proportional valve 41 so that a relief pressure of the relief valve 40 is set to the pressure B that is lower than the pressure A (step S105).

When the controller 53 determines that the tilt lever 32 has not been operated (NO at S104), the controller 53 outputs an electric signal for moving the valve body 47 of the electromagnetic proportional valve 41 to the third position to the solenoid operation unit 48 of the electromagnetic proportional valve 41 so that a relief pressure of the relief valve 40 is set to the pressure C that is lower than the pressure B (step S106).

The steps S101, S102, and S104 are performed by the lever operation determination unit 54. The steps S103, S105, and S106 are performed by the valve control unit 55.

In the hydraulic drive device 1 described above, when the lift lever 28 is operated to lift up, hydraulic oil discharged from the hydraulic pump 4 is supplied through the hydraulic oil passage 12, the priority valve 35, the hydraulic oil passage 29, the lift valve 27, and the hydraulic oil passage 16 to the lift cylinder 8, with the result that the lift cylinder 8 extends. Then, the pilot line 30 has a pilot pressure corresponding to a discharge pressure of the hydraulic pump 4. Accordingly, the pilot pressure of the pilot line 30 is higher than the pilot pressure of the pilot line 20. This means that the pilot pressure of the pilot line 30 is provided to the capacity control valve 5 through the pilot line 19 by the shuttle valve 38. Then, the capacity control valve 5 controls the hydraulic pump 4 so that a differential pressure between a discharge pressure of the hydraulic pump 4 and the pilot pressure of the pilot line 19 is to be a predetermined pressure and so that the discharge pressure of the hydraulic pump 4 is to be a predetermined upper limit pressure of less.

In this time, the lifting operation of the lift lever 28 moves the valve body 47 of the electromagnetic proportional valve 41 to the first position, so that a pilot pressure generated in the pilot line 30 is provided to the bottom chamber 42*a* of the pressure cylinder 42, and then, a relief pressure of the relief valve 40 is set to the pressure A corresponding to the pilot pressure generated in the pilot line 30. Thus, the upper limit value of the pilot pressure provided to the capacity control valve 5 becomes the pressure A. This means that the upper limit pressure of hydraulic oil discharged from the hydraulic pump 4 becomes the pump cut-off pressure.

When the tilt lever 32 is operated to tilt forward, hydraulic oil discharged from the hydraulic pump 4 is supplied through the hydraulic oil passage 12, the priority valve 35, the hydraulic oil passages 29, 33, the tilt valve 31, and the hydraulic oil passage 17 to the bottom chamber 9*a* of the tilt cylinder 9, with the result that the tilt cylinder 9 extends. Then, the pilot line 34A has a pilot pressure corresponding to a discharge pressure of the hydraulic pump 4. Accordingly, similarly to the extension of the lift cylinder 8, the pilot pressure of the pilot line 34A is provided to the capacity control valve 5 through the pilot lines 30, 19.

When the tilt lever 32 is operated to tilt backward, hydraulic oil discharged from the hydraulic pump 4 is supplied through the hydraulic oil passage 12, the priority valve 35, the hydraulic oil passages 29, 33, the tilt valve 31, and the hydraulic oil passage 18 to the rod chamber 9*b* of the tilt cylinder 9, with the result that the tilt cylinder 9 retracts. Then, the pilot line 34B has a pilot pressure corresponding to a discharge pressure of the hydraulic pump 4. Accordingly, similarly to the extension of the lift cylinder 8, the pilot pressure of the pilot line 34B is provided to the capacity control valve 5 through the pilot lines 30, 19.

In this time, operating the tilt lever 32 moves the valve body 47 of the electromagnetic proportional valve 41 to the second position, so that a pressure of the bottom chamber 42*a* of the pressure cylinder 42 becomes lower than that in the extension of the lift cylinder 8, and then, a relief pressure of the relief valve 40 is set to the pressure B that is lower than the pressure A. Accordingly, the upper limit value of the pilot pressure provided to the capacity control valve 5 becomes the pressure B. Thus, the upper limit pressure of hydraulic oil discharged from the hydraulic pump 4 becomes a total pressure of the pressure B and the pump control pressure.

In no operation time when the lift lever 28 and the tilt lever 32 are not operated, the valve body 47 of the electromagnetic proportional valve 41 moves to the third position, so that the pressure cylinder 42 communicates with the tank 3 and a pressure of the bottom chamber 42*a* of the pressure cylinder 42 becomes a tank pressure that is lower than that in the operation of the tilt cylinder 9, and then, a relief pressure of the relief valve 40 is set to the pressure C that is lower than the pressure B. Accordingly, the upper limit value of pilot pressure provided to the capacity control valve 5 becomes the pressure C. Thus, the upper limit pressure of hydraulic oil discharged from the hydraulic pump 4 becomes a total pressure of the pressure C and the pump control pressure.

As described above, in the present embodiment, operation states of the lift lever 28 and the tilt lever 32 are detected, and the electromagnetic proportional valve 41 is controlled so that a relief pressure of the relief valve 40 disposed between the pilot line 30 and the tank 3 is different in accordance with the case where the lift lever 28 has been operated or the tilt lever 32 has been operated. Thus, the relief pressure of the relief valve 40 when the lift cylinder 8 is operated is different from the relief pressure of the relief valve 40 when the tilt cylinder 9 is operated. This means that the upper limit pressure of hydraulic oil discharged from the hydraulic pump 4 is different in accordance with the case where the lift cylinder 8 has been operated or the tilt cylinder 9 has been operated. Thus, the upper limit pressure of hydraulic oil discharged from the hydraulic pump 4 may be changed in accordance with an operated hydraulic cylinder.

In the present embodiment, a relief pressure of the relief valve 40 when the tilt cylinder 9 is operated is lower than that when the lift cylinder 8 is operated, so that the upper limit pressure discharged from the hydraulic pump 4 becomes lower. Accordingly, the tilt cylinder 9 may be protected.

In the present embodiment, a pressure of the pressure cylinder 42 when the lift lever 28 is operated is higher than that when the tilt lever 32 is operated, so that pressure force of the relief valve 40 by the piston 43 becomes larger. Thus, a relief pressure of the relief valve 40 when the lift cylinder 8 is operated is surely higher than that when the tilt cylinder 9 is operated.

In the present embodiment, when neither the lift lever 28 nor the tilt lever 32 has been operated, a pressure of the pressure cylinder 42 becomes the tank pressure. This minimizes pressure force of the relief valve 40 by the piston 43. Thus, a relief pressure of the relief valve 40 may be set to the pressure corresponding to urging force of the spring 40*a* disposed in the relief valve 40.

Figure 5:
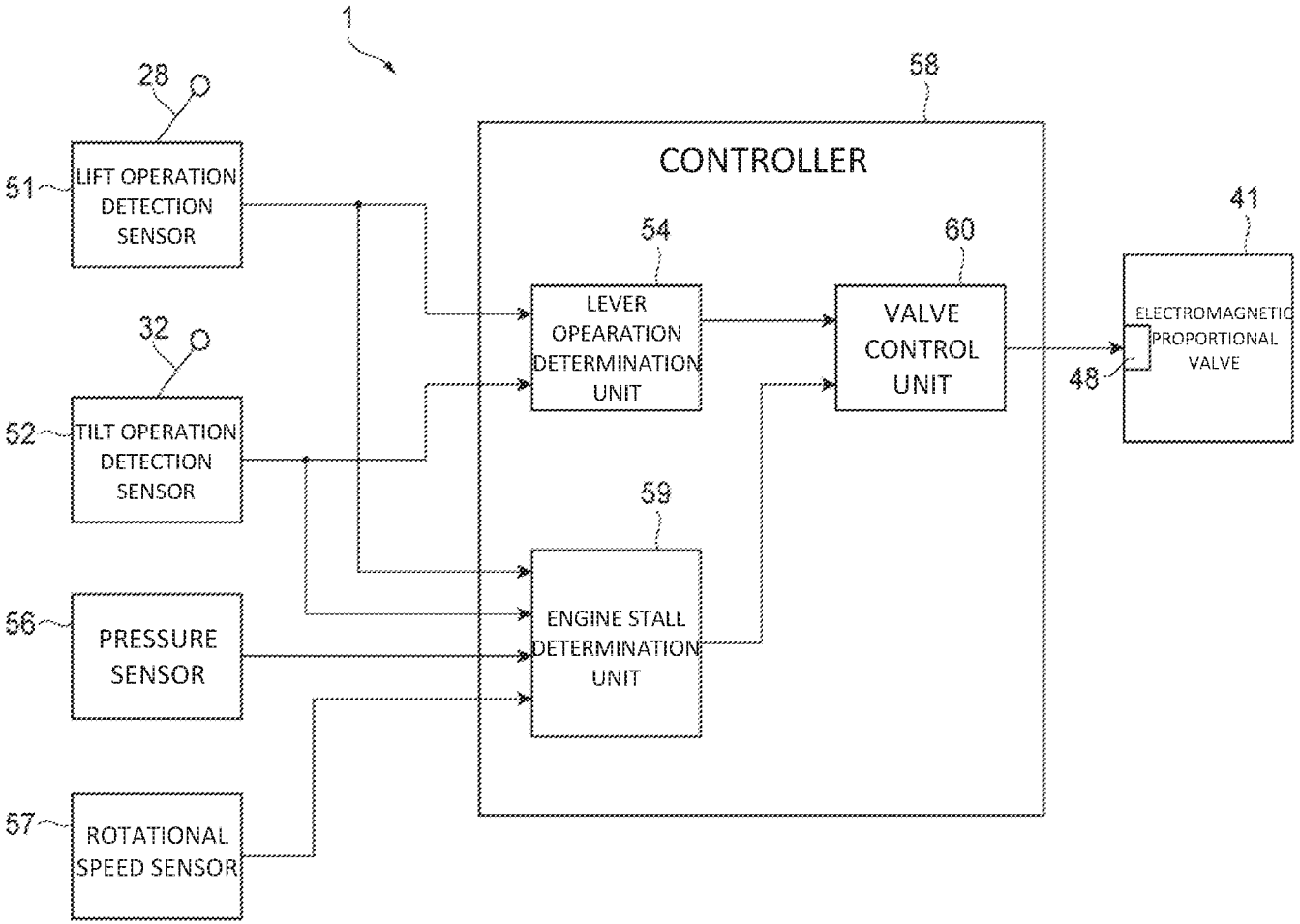
FIG. 5 is a block diagram showing a control system of a hydraulic drive device for an industrial vehicle according to another embodiment of the present disclosure.

FIG. 5 is a block diagram showing a control system of a hydraulic drive device for an industrial vehicle according to another embodiment of the present disclosure. As illustrated in FIG. 5, the hydraulic drive device 1 of the present embodiment includes the above lift operation detection sensor 51, the above tilt operation detection sensor 52, a pressure sensor 56, a rotational speed sensor 57, and a controller 58 (control unit).

The pressure sensor 56 corresponds to a load detection portion detecting loads applied to the lift cylinder 8 and the tilt cylinder 9 by detecting a pressure of the bottom chamber 8*a* of the lift cylinder 8 and a pressure of the bottom chamber 9*a* and the rod chamber 9*b* of the tilt cylinder 9. Loads applied to the lift cylinder 8 and the tilt cylinder 9 include weights of the cargos W stacked on the forks 11. The pressure sensor 56 detects a pressure of a detection line 61 (see FIG. 2) connected to, for example, the pilot lines 30, 34A, 34B. The rotational speed sensor 57 corresponds to a rotational speed detection portion detecting rotational speed of the engine 21.

The controller 58 has the above lever operation determination unit 54, an engine stall determination unit 59, and a valve control unit 60.

The engine stall determination unit 59 determines whether or not there is a possibility that the engine 21 of the forklift 2 stalls on the basis of an operation state of the lift lever 28 detected by the lift operation detection sensor 51, an operation state of the tilt lever 32 detected by the tilt operation detection sensor 52, loads applied to the lift cylinder 8 and the tilt cylinder 9 detected by the pressure sensor 56, and rotational speed of the engine 21 detected by the rotational speed sensor 57.

The valve control unit 60 controls the solenoid operation unit 48 of the electromagnetic proportional valve 41 in accordance with a determined result by the lever operation determination unit 54. Then, the valve control unit 60 controls the solenoid operation unit 48 of the electromagnetic proportional valve 41 so that a relief pressure of the relief valve 40 when the lift lever 28 is operated is different from the relief pressure of the relief valve 40 when the tilt lever 32 is operated. In addition, when the engine stall determination unit 59 has determined that there is a possibility that the engine 21 of the forklift 2 stalls, the valve control unit 60 controls the solenoid operation unit 48 of the electromagnetic proportional valve 41 so that the relief pressure of the relief valve 40 becomes lower than that when the lift ever 28 and the tilt lever 32 are operated.

Figure 6:
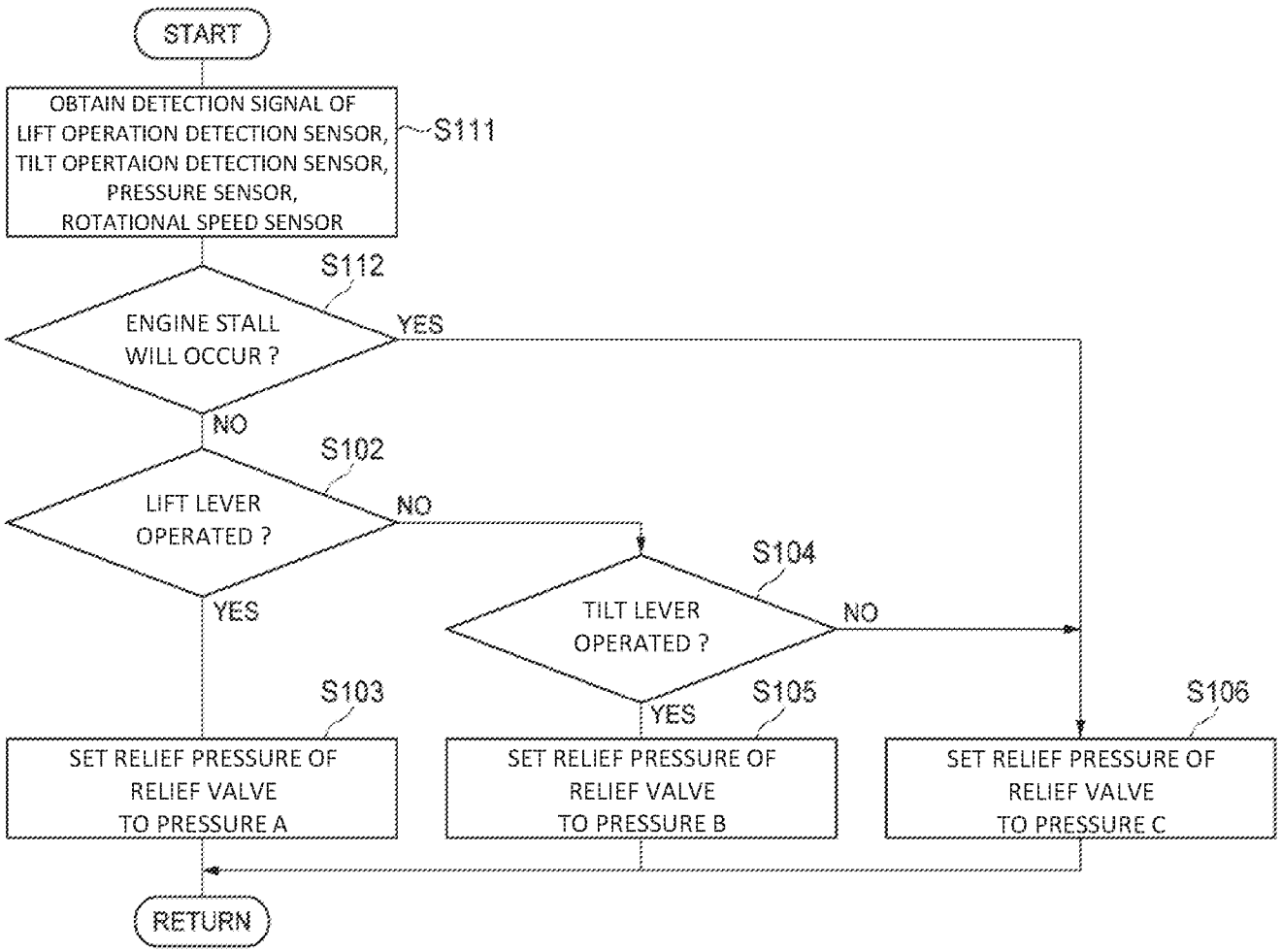
FIG. 6 is a flow chart showing steps of a control process performed by a controller illustrated in FIG. 5.

FIG. 6 is a flow chart showing steps of a control process performed by the controller 58. As illustrated in FIG. 6, the controller 58 firstly obtains detection signals of the lift operation detection sensor 51, the tilt operation detection sensor 52, the pressure sensor 56, and the rotational speed sensor 57 (step S111).

Subsequently, the controller 58 determines whether or not there is a possibility that the engine 21 of the forklift 2 stalls on the basis of detection signals of the lift operation detection sensor 51, the tilt operation detection sensor 52, the pressure sensor 56, and the rotational speed sensor 57 (step S112).

Then, in the controller 58, a determination map, which shows a relationship between a probability that the engine 21 of the forklift 2 stalls and, for example, operation amounts and operation speeds of the lift lever 28 and the tilt lever 32, loads applied to the lift cylinder 8 and the tilt cylinder 9, and rotational speed of the engine 21, has been installed in advance. The controller 58 uses the determination map, and then, determines that there is a possibility that the engine 21 of the forklift 2 stalls when the probability that the engine 21 of the forklift 2 stalls is equal to or greater than a predetermined value.

When the controller 58 determines that there is a possibility that the engine 21 of the forklift 2 stalls (YES at S112), the controller 58 outputs an electric signal for moving the valve body 47 of the electromagnetic proportional valve 41 to the third position to the solenoid operation unit 48 of the electromagnetic proportional valve 41 so that a relief pressure of the relief valve 40 is set to the pressure C (step S106). When the controller 58 determines that there is no possibility that the engine 21 of the forklift 2 stalls (NO at S112), the controller 58 performs the steps S102 to S106, similarly to the above embodiment.

The steps S111, S112 are performed by the engine stall determination unit 59. The steps S111, S102, and S104 are performed by the lever operation determination unit 54. The steps S103, S105, and S106 are performed by the valve control unit 60.

In this way, in the present embodiment, when there is a possibility that the engine 21 of the forklift 2 stalls, a relief pressure of the relief valve 40 becomes lower than that when the lift lever 28 and the tilt lever 32 are operated, so that the upper limit pressure discharged from the hydraulic pump 4 becomes lower. Therefore, a load applied to the engine 21 is reduced, restraining the engine 21 of the forklift 2 from stalling.

In the present embodiment, when there is a possibility that the engine 21 of the forklift 2 stalls, a relief pressure of the relief valve 40 is set to the pressure C corresponding to the tank pressure. However, the present disclosure is not particularly limited to the embodiment. Under the same circumstances, a relief pressure of the relief valve 40 needs to be set to a pressure that is lower than the pressure B when the tilt lever 32 is operated.

Although some embodiments according to the present disclosure have been described above, the present disclosure is not limited to the above embodiments. For example, in the present embodiment, a potentiometer or the like is used as the lift operation detection sensor 51 and the tilt operation detection sensor 52. However, a limit switch may be used as the lift operation detection sensor 51 and the tilt operation detection sensor 52 if it is only needed to detect whether or not the lift lever 28 and the tilt lever 32 are operated.

In the above embodiment, in no operation time when neither the lift lever 28 nor the tilt lever 32 is operated, a relief pressure of the relief valve 40 is set to the pressure C corresponding to the tank pressure. However, the present disclosure is not particularly limited to the embodiment. Under the same circumferences, a relief pressure of the relief valve 40 may be set to the pressure A, as is the case when the lift lever 28 is operated.

In the above present embodiment, a relief pressure of the relief valve 40 is set by the electromagnetic proportional valve 41 and the pressure cylinder 42. However, the relief pressure setting portion that sets the relief pressure of the relief valve 40 is not particularly limited to the embodiment. The relief pressure setting portion may have a configuration such that the relief pressure of the relief valve 40 when the lift cylinder 8 is operated is higher than that when the tilt cylinder 9 is operated.

In the above present embodiment, the lift valve 27 is a mechanical direction switching valve to which the lift lever 28 is attached. However, the lift valve 27 is not particularly limited to a mechanical direction switching valve, and may be an electromagnetic direction switching valve. In this case, the lift valve is controlled on the basis of a detection signal of the lift operation detection sensor 51, so that a flow direction of hydraulic oil is changed in accordance with an operation of the lift lever. In addition, the tilt valve 31 is a mechanical direction switching valve to which the tilt lever 32 is attached. However, the tilt valve 31 is not particularly limited to a mechanical direction switching valve, and may be an electromagnetic direction switching valve. In this case, the tilt valve is controlled in accordance with a detection signal of the tilt operation detection sensor 52, so that a flow direction of hydraulic oil is changed in accordance with an operation of the tilt lever.

In the above embodiment, an attachment cylinder is not mounted to the forklift 2. However, the present disclosure is applicable to a forklift to which an attachment cylinder such as a side shift cylinder shifting the forks 11 rightward and leftward is mounted. In this case, when an attachment lever for moving the attachment cylinder is operated, a relief pressure of the relief valve 40 is set to the same pressure as that when the tilt lever 32 is operated.

In the above embodiment, the hydraulic drive device 1 of the forklift 2 including the lift cylinder 8 and the tilt cylinder 9 is described. However, the present disclosure is applicable to any industrial vehicle as long as the industrial vehicle includes a plurality of hydraulic cylinders.

What is claimed is:

1. A hydraulic drive device for an industrial vehicle comprising:

a tank for storing hydraulic oil, a hydraulic pump that is of a variable capacity type, driven by an engine and discharges the hydraulic oil stored in the tank, a capacity control valve controlling the hydraulic pump, a lift cylinder driven by the hydraulic oil discharged from the hydraulic pump, and which raises and lowers a cargo, a tilt cylinder driven by the hydraulic oil discharged from the hydraulic pump, a lift valve disposed between the hydraulic pump and the lift cylinder, and switching a flow direction of the hydraulic oil in accordance with operation of a lift lever for operating the lift cylinder, a tilt valve disposed between the hydraulic pump and the tilt cylinder, and that switches the flow direction of the hydraulic oil in accordance with operation of the tilt lever, a first hydraulic oil passage connecting the hydraulic pump, the lift valve and the tilt valve, and through which the hydraulic oil discharged from the hydraulic pump flows, a plurality of second hydraulic oil passages connecting the lift valve and the lift cylinder, and connecting the tilt valve and the tilt cylinder, and through which the hydraulic oil supplied to the lift cylinder and the tilt cylinder flows, a pilot line connecting the lift valve, the tilt valve, and the capacity control valve, and supplying a pilot pressure generated when the hydraulic oil is supplied to the lift cylinder and the tilt cylinder to the capacity control valve, a relief valve disposed between the pilot line and the tank, and that opens when the pilot pressure generated in the pilot line is equal to or greater than a relief pressure, a relief pressure setting portion that sets the relief pressure of the relief valve, wherein the relief pressure setting portion has an electromagnetic proportional valve connected to the pilot line and a pressure cylinder disposed between the electromagnetic proportional valve and the relief valve, and having a piston pressing the relief valve, a lift operation detection sensor detecting an operation state of the lift lever, a tilt operation detection sensor detecting the operation state of the tilt lever, and a control unit controlling the relief pressure setting portion on the basis of the operation states of the lift lever and the tilt lever detected by the lift operation detection sensor and the tilt operation detection sensor, wherein the capacity control valve controls the hydraulic pump so that a differential pressure between a discharge pressure of the hydraulic pump and the pilot pressure of the pilot line is to be a predetermined pressure, and controls the hydraulic pump so that the discharge pressure of the hydraulic pump is to be a predetermined upper limit pressure or less, and the control unit controls the electromagnetic proportional valve such that the relief pressure of the relief valve when the lift lever is operated is set to equal to or greater than the predetermined upper limit pressure, and the relief pressure of the relief valve when the tilt lever is operated is set to be lower than the relief pressure of the relief valve when the lift lever is operated.

2. The hydraulic drive device for the industrial vehicle according to claim 1, wherein the control unit controls the electromagnetic proportional valve so that the pressure cylinder communicates with the tank when the lift lever and the tilt lever are not operated.

3. The hydraulic drive device for the industrial vehicle according to claim 1, further comprising:

a load detection portion detecting loads applied to the lift cylinder and the tilt cylinder, and a rotational speed detection portion detecting rotational speed of the engine, wherein the control unit determines whether or not there is a possibility that the engine of the industrial vehicle stalls on the basis of the operation states of the lift lever and the tilt lever detected by the lift operation detection sensor and the tilt operation detection sensor, the loads applied to the lift cylinder and the tilt cylinder detected by the load detection portion, and the rotational speed of the engine detected by the rotational speed detection portion, and when the control unit determines that there is a possibility that the engine of the industrial vehicle stalls, the control unit controls the relief pressure setting portion so that the relief pressure of the relief valve is lower than that when the lift lever and the tilt lever are operated.

* * * * *